US007984942B2

(12) United States Patent
Schaupensteiner et al.

(10) Patent No.: US 7,984,942 B2
(45) Date of Patent: Jul. 26, 2011

(54) FLAP CONFIGURATION

(75) Inventors: Walter Schaupensteiner, Rutesheim (DE); Werner Maier, Leonberg (DE); Martin Frank, Muehlacker (DE)

(73) Assignee: Dr. Ing. h.c. F. Porsche AG, Stuttgart (DE)

( * ) Notice: Subject to any disclaimer, the term of this patent is extended or adjusted under 35 U.S.C. 154(b) by 238 days.

(21) Appl. No.: 12/337,827

(22) Filed: Dec. 18, 2008

(65) Prior Publication Data

US 2009/0152887 A1 Jun. 18, 2009

(30) Foreign Application Priority Data

Dec. 18, 2007 (DE) ..... 10 2007 061 055

(51) Int. Cl.
*B60R 7/06* (2006.01)
*E05C 1/06* (2006.01)

(52) U.S. Cl. ..... 296/37.12; 296/37.8; 296/24.34; 292/33

(58) Field of Classification Search ..... 296/24.34, 296/70, 37.8, 37.12; 292/32–36, 41, 254, 292/DIG. 37; 220/263, 523, 558
See application file for complete search history.

(56) References Cited

U.S. PATENT DOCUMENTS

| | | | | |
|---|---|---|---|---|
| 2,366,847 | A | 1/1945 | Fendring | |
| 4,902,052 | A | 2/1990 | Laine | |
| 6,120,069 | A * | 9/2000 | Taranto | 292/35 |
| 6,669,243 | B2 * | 12/2003 | Katoh et al. | 292/34 |
| 7,036,852 | B2 * | 5/2006 | Cho | 292/33 |
| 7,156,440 | B2 * | 1/2007 | Katagiri | 296/37.12 |
| 7,475,929 | B2 * | 1/2009 | Yamada | 296/24.34 |
| 7,766,409 | B2 * | 8/2010 | Ohnuki | 296/37.12 |
| 2008/0022730 | A1 | 1/2008 | Dietrich et al. | |
| 2009/0152887 | A1 * | 6/2009 | Schaupensteiner et al. | 296/37.12 |

FOREIGN PATENT DOCUMENTS

| | | |
|---|---|---|
| DE | 38 25 440 A1 | 2/1989 |
| DE | 10354645 B3 | 2/2005 |
| DE | 10 2004 015 068 A1 | 10/2005 |

OTHER PUBLICATIONS

German Patent and Trademark Office Search Report dated Apr. 24, 2008.

* cited by examiner

*Primary Examiner* — Glenn Dayoan
*Assistant Examiner* — Gregory Blankenship

(57) ABSTRACT

A flap configuration has a flap for closing a receptacle and a closing slide guided displaceably parallel to the flap plane in the closing slide guide. The closing slide is inserted with one end into a latching opening in a wall and brought out of engagement with the latching opening by a closing slide drive against a spring force by way of a latch element guided in the latching opening. In an opposite receptacle wall from the latching opening, a guide opening is positioned coaxially with the latching opening and the closing slide guide. In the latching opening, a closing latch biased in the direction of the closing slide is guided, and engages, when the flap is latched in place, in an open end of the closing slide guide. The closing slide drive unlatches the flap.

8 Claims, 2 Drawing Sheets

FLAP CONFIGURATION

CROSS-REFERENCE TO RELATED APPLICATION

This application claims the priority, under 35 U.S.C. §119, of German application DE 10 2007 061 055.8, filed Dec. 18, 2007; the prior application is herewith incorporated by reference in its entirety.

BACKGROUND OF THE INVENTION

Field of the Invention

The present invention relates to a flap configuration having a flap for closing a receptacle. The flap configuration further has a closing slide guided displaceably parallel to the flap plane in a closing slide guide. The closing slide may be inserted with one end into a corresponding latching opening in a receptacle wall and brought out of engagement with the latching opening by a closing slide drive against a spring force by way of a latch element guided in the latching opening. The invention also relates to a motor vehicle provided with such a flap configuration.

A flap configuration of the generic type is known from U.S. Pat. No. 7,156,440 B2, in which a closing slide formed of two individual slides is guided in a closing slide guide of a glove compartment. The two individual slides are coupled together at their mutually facing ends by a toothed wheel and biased away from one another by a spring device. When the flap is latched in place, the closing slide travels with its two longitudinal ends into corresponding latching openings arranged in a receptacle wall and is moved out of the latching opening by a latch element guided in one of the latching openings to open the flap, i.e. for unlatching thereof. The latching mechanism, in particular the part thereof arranged on the flap itself, is structurally complex, however.

Published, non-prosecuted German patent application DE 10 2004 015 068 A1 discloses a further flap configuration with a flap swivelable about a swivel axis for closing a glove compartment in a motor vehicle. This flap configuration contains in particular a displaceably guided closing slide, which is engageable with a longitudinal end in the corresponding latching opening of the glove compartment and is movable out of engagement with the latching opening by a closing slide drive against a spring force. The closing slide drive and a latching drive for latching the closing slide in its engaged position in the latching opening may be movably driven by a joint motorized drive.

SUMMARY OF THE INVENTION

It is accordingly an object of the invention to provide a flap configuration that overcomes the above-mentioned disadvantages of the prior art devices of this general type, which is an improved or at least a different embodiment of a flap configuration of the above type which is distinguished in particular by a structurally different latching device.

With the foregoing and other objects in view there is provided, in accordance with the invention, a flap configuration. The flap configuration contains a flap for closing a receptacle, a closing slide guide, a closing slide drive, a latch element, a first receptacle wall having a latching opening, and a closing slide guided displaceably parallel to a flap plane in the closing slide guide. The closing slide can be inserted with one end into the latching opening in the receptacle wall and brought out of engagement with the latching opening by the closing slide drive against a spring force by way of the latch element guided in the latching opening. A second receptacle wall is disposed opposite the first receptacle wall and has a guide opening positioned coaxially with the latching opening and coaxially with the closing slide guide. A closing latch is guided in the guide opening and is biased in a direction of the closing slide. The closing latch engages, when the flap is latched in place, in an open end of the closing slide guide. The closing slide drive unlatches the flap by moving the closing slide out of the latching opening by use of the latch element and simultaneously moving the closing latch out of the closing slide guide.

The invention is based on the general idea of providing, in the case of a flap configuration having a swivelably mounted flap, a closing slide guide in the latter which is open at both ends and thus continuous and in which a spring-biased closing slide is guided which may be slid with one end into a latching opening in a receptacle wall on closure. Opposite the latching opening and aligned therewith or with the closing slide guide in the flap there is provided a guide opening in the opposing receptacle wall, in which likewise a spring-loaded closing latch is guided and biased in the direction of the closing slide guide in the flap, which closing slide guide is positioned coaxially with the guide opening. When the flap is closed, the closing slide thus engages in the latching opening in the receptacle wall and the closing latch in the receptacle wall engages in the closing slide guide in the flap, whereby a completely novel latching concept may be achieved. For unlatching purposes a closing slide drive is provided, which, via a latch element guided displaceably in the latching opening in the receptacle wall, exerts a force on the closing slide guided in the flap counter to the spring force of the closing slide and thereby drives the latter out of the latching opening. At the same time, due to this driving of the closing slide out of the latching opening, the closing slide is pushed against the closing latch mounted displaceably in the opposing guide opening, whereby the closing latch is pushed out of the closing slide guide in the flap and the flap is released for opening purposes. In this case, to unlatch the flap by the latch element, the closing slide drive moves the closing slide out of the latching opening and at the same time the closing latch out of the closing slide guide. In this way, the completely novel latching concept may be achieved in which not only does a closing slide arranged displaceably in the flap engage in a latching opening in a receptacle wall but also a closing latch in a receptacle wall engages in an opening in the flap, namely an open end of the closing slide guide.

According to an advantageous further development of the solution according to the invention, the flap takes the form of a flap swivelable about a swivel axis for closing the glove compartment in a motor vehicle. In the case in particular of glove compartments in motor vehicles, secure closure is of particular importance, since it is often desired to hide valuable items from view in glove compartments. The double-acting closing mechanism ensures that the flap can be particularly securely and reliably latched shut.

According to a further advantageous embodiment of the invention, the closing slide drive functions purely mechanically. This offers the major advantage that it is straightforwardly possible to open the glove compartment even if the vehicle electrical system fails. Alternatively or in addition, it is of course also possible to provide an electrical closing slide drive, which during normal use allows easy opening of the flap of the flap configuration.

In a further advantageous embodiment, the closing slide and the closing latch each contain a beveled closing edge, which, upon closure of the flap, bring about displacement of the closing slide and of the closing latch and introduction thereof into the associated latching opening or closing slide guide respectively and reliably fix them in the latching opening or closing slide guide respectively when the flap is closed. Such beveled closing latches or closing slides are widely known, the bevel according to the invention on the closing latch being of opposite construction to the bevel on the closing slide, in order to allow problem-free closure, i.e. latching of the flap.

It goes without saying that the above-mentioned features and those still to be explained below may be used not only in the respectively stated combination but also in other combinations or alone, without going beyond the scope of the present invention.

Other features which are considered as characteristic for the invention are set forth in the appended claims.

Although the invention is illustrated and described herein as embodied in a flap configuration, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
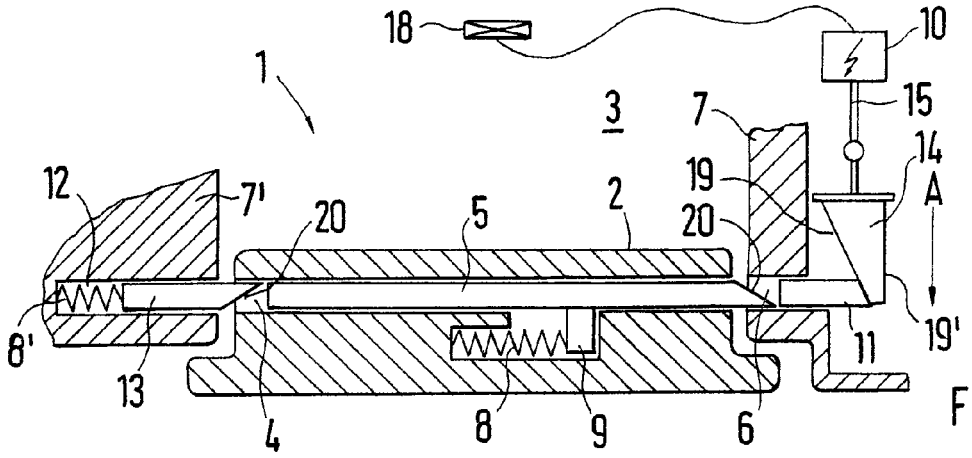
FIG. 1 is a diagrammatic, sectional view of a flap configuration according to the invention with a closed or latched flap according to the invention.

Referring now to the figures of the drawing in detail and first, particularly, to FIG. 1 thereof, there is shown a flap configuration 1 according to the invention that contains a flap 2, with which a receptacle 3, only illustrated in part, may be closed. The flap 2 may for example take the form of a flap 2 swivelable about a swivel axis for closing a glove compartment in a motor vehicle. Parallel to the flap plane, i.e. according to FIGS. 1 to 3 in the flap plane, a closing slide guide 4 is provided with a closing slide 5 guided displaceably therein. The closing slide 5 may be inserted with one of its longitudinal ends, according to FIGS. 1 to 3 with its, in each case, right-hand longitudinal end, into a corresponding latching opening 6 in a receptacle wall 7 of the receptacle 3 and in the inserted state latches the flap 2 in place. The closing slide 5 is here biased via a corresponding spring 8, for example a compression spring, in the direction of the latching opening 6, such that automatic unlatching is prevented. The spring 8 is likewise arranged within the flap plane and rests on the one hand against the flap 2 and on the other hand against a bracket 9 of the closing slide 5.

To unlatch the closing slide 5 a closing slide drive 10 is provided, which moves a latch element 11 guided in the latching opening 6 against the spring force of the spring 8 and thereby pushes the longitudinal end of the closing slide 5 engaging in the latching opening 6 out of the latching opening 6. In the opposite receptacle wall 7' from the latching opening 6 a guide opening 12 positioned coaxially with the latching opening 6 and with the closing slide guide 4 is provided, in which a closing latch 13 biased in the direction of the closing slide 5 is guided. Like the closing slide 5, this is biased by a corresponding spring 8', and indeed to the right according to FIGS. 1 to 3. When the flap 2 is latched in place, the closing latch 13 engages in an open end of the closing slide guide 4, as shown for example in FIG. 1. The closing slide drive 10 unlatches the flap 2 by moving or pushing the closing slide 5 out of the latching opening 6 by the latch element 11 and simultaneously moving or pushing the closing latch 13 out of the closing slide guide 4 by the closing slide 5.

Figure 2:
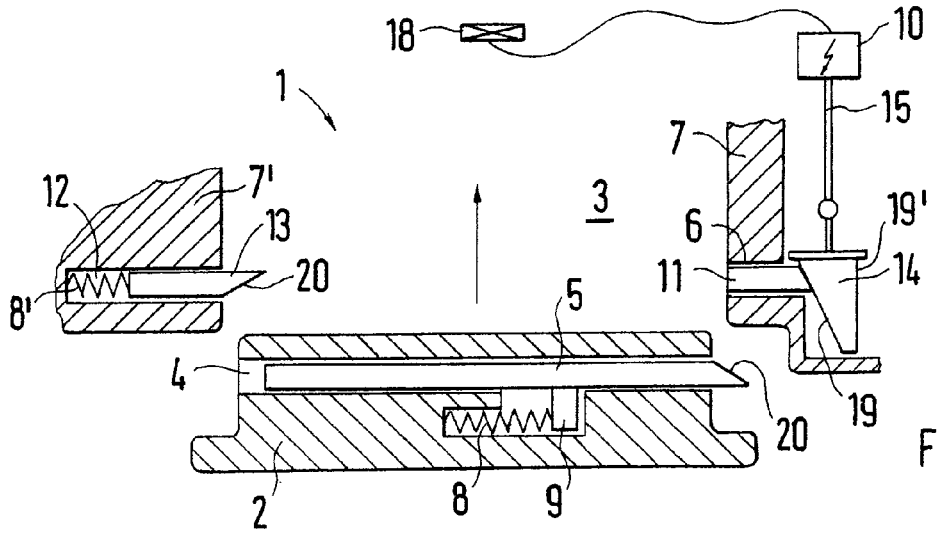
FIG. 2 is a diagrammatic, sectional view as in FIG. 1, but with the flap open.
Figure 3:
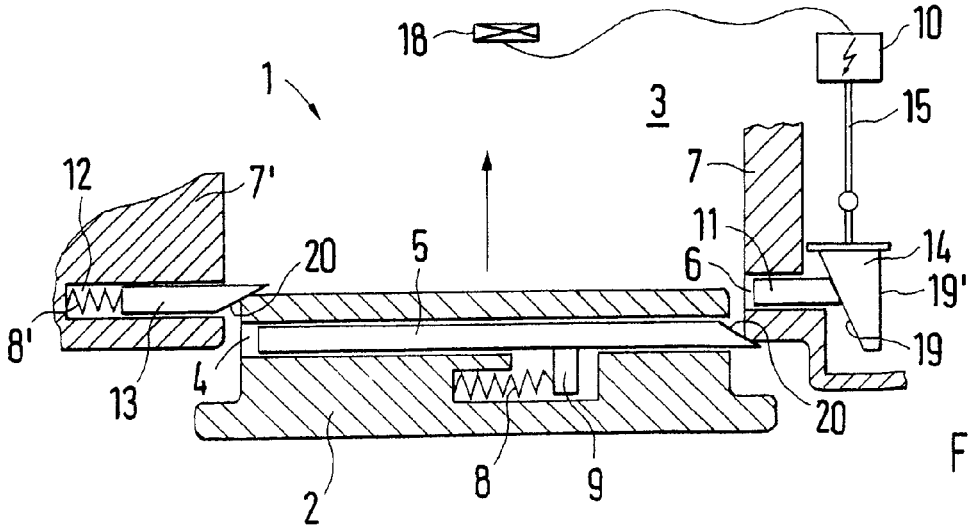
FIG. 3 is a diagrammatic, sectional view as in FIG. 2, but upon closure of the flap.

As is clear from FIGS. 1 to 3, in principle two closing elements are provided to latch the flap 2 in place, namely the closing latch 13 and the closing slide 5. Since these are arranged coaxially with one another, the two may be displaced jointly by way of the closing slide drive 10 into an unlatched position. To this end, the closing slide drive 10 contains a wedge element 14 movable orthogonally to the direction of displacement of the latch element 11. Between the wedge element 14 and the closing slide drive 10 there is additionally provided a coupling member 15, which for example allows articulated mounting between the closing slide drive 10 on the one hand and the wedge element 14 on the other hand. In principle a very wide range of embodiments of closing slide drives 10 are possible, wherein according to FIGS. 1 to 3 the closing slide drive 10 contains an electrical actuator, for example an electric motor. However, an electrical stepping motor is also conceivable, as shown for example in FIG. 4, on a shaft 16 of which there is arranged an eccentric 17 for displacing the latch element 11. The closing slide drive 10 is activated for example by an actuating element 18, which is preferably arranged so as to be ergonomically favorable for a driver of the motor vehicle. It is of course also feasible for the closing slide drive 10 to function purely mechanically, for example by a Bowden cable, so enabling energy-independent opening of the flap 2. It goes without saying that such electricity-independent opening of the flap 2 may also be provided as an addition.

Opening of the flap 2 here functions in principle as now described.

First of all, an appropriate impulse is sent via the actuating element 18 to the closing slide drive 10, which thereupon moves the wedge element 14 in direction A, i.e. in a downwards direction in this case (see FIG. 1), by the coupling member 15. With the downwards displacement of the wedge element 14 the latter slides with a wedge face 19 along a wedge face 19' formed in a matching manner on the latch element 11 and effects movement of the latch element 11 in direction B, i.e. to the left in this case. When the latch element 11 is moved leftwards, it pushes on the closing slide 5, whereby the right-hand longitudinal end of the latter is moved out of the latching opening 6. At the same time, the closing slide 5 lies with its end remote from the latching opening 6 against the closing latch 13, such that leftwards displacement of the latch element 11 at the same time brings about leftwards displacement of the closing slide 5 and of the closing latch 13. Due to the leftwards displacement of the closing latch 13, the end thereof engaging in the closing slide guide 4 is moved out of the guide, such that, once the closing latch 13 no longer engages in the closing slide guide 4 and the closing slide 5 no longer engages in the latching opening 6, the flap 2 may be opened. This situation is illustrated in FIG. 2. In order to simplify closure of the flap 2, both the closing slide 5 and the closing latch 13 in each case contain a beveled closing edge 20, which effects displacement of the closing slide 5 or of the closing latch 13 respectively upon closure of the flap 2 to the extent that the closing latch 13 slides along a side wall of the flap 2 and the closing slide 5 slides along the receptacle wall 7 until the closing latch 13, the closing slide 5 and the latch element 11 are aligned with one another. In this situation the closing latch 13 is pushed by the spring 8' into the open end of the closing slide guide 4 and the closing slide 5 is pushed by the spring 8 into the latching opening 6, so closing the flap 2. At the same time, the wedge element 14 of the closing slide drive 10 finds itself back in its starting position illustrated in FIG. 1. It is of course feasible for the flap 2 illustrated in FIGS. 1 to 3 not merely to take the form of a glove compartment flap but instead in principle to be suitable for any type of closable flaps or lids.

The flap configuration 1 according to the invention provides a completely novel latching concept unlike anything described in the prior art. In particular it is possible with the flap configuration 1 according to the invention for two mutually independently operating closing elements, namely the closing latch 13 and the closing slide 5, to be unlatched by a single closing slide drive 10.

Figure 4:
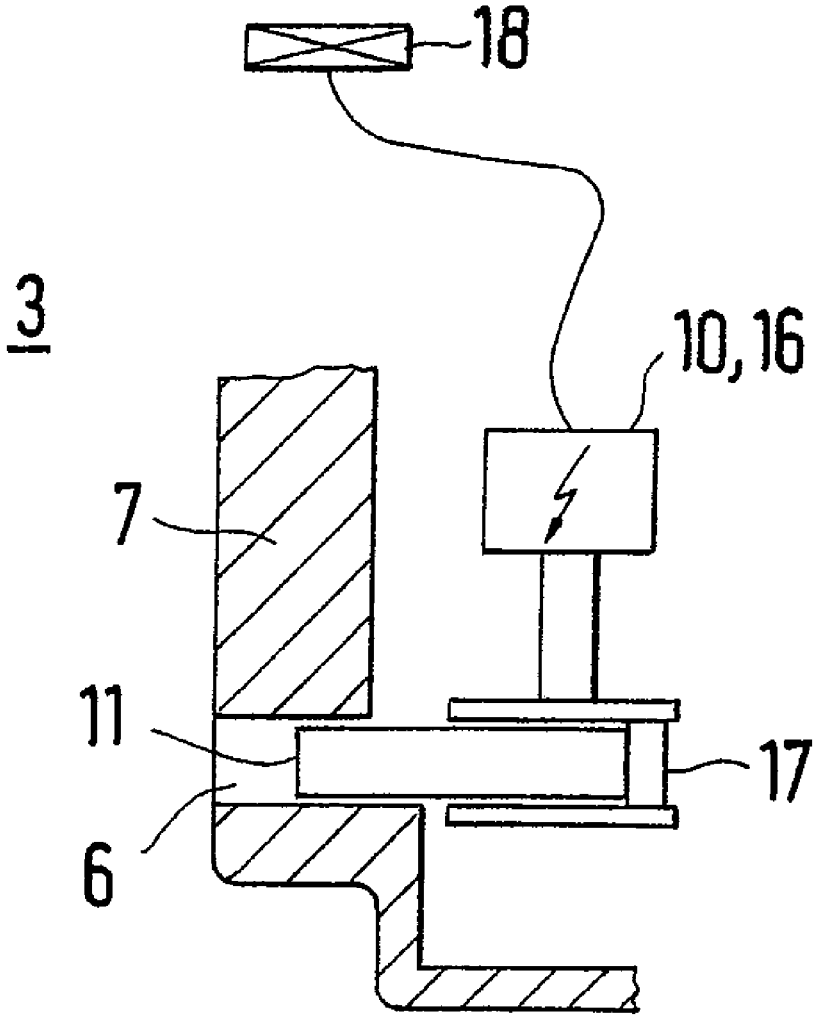
FIG. 4 is a diagrammatic, sectional view of a possible embodiment of a closing slide drive.

An examination of FIG. 4 makes it clear that, instead of the wedge element 14, for example an eccentric 17 or any other desired embodiment may be selected to move the latch element 11, whereby the closing slide drive 10 may in particular be individually adapted to the most varied requirements.

The invention claimed is:

1. A flap configuration, comprising:

a flap for closing a receptacle;

a closing slide guide;

a closing slide drive;

a latch element;

a first receptacle wall having a latching opening formed therein;

a closing slide guided displaceably parallel to a flap plane in said closing slide guide, said closing slide can be inserted with one end into said latching opening in said receptacle wall and brought out of engagement with said latching opening by said closing slide drive against a spring force by way of said latch element guided in said latching opening;

a second receptacle wall being opposite said first receptacle wall and having a guide opening formed therein positioned coaxially with said latching opening and coaxially with said closing slide guide; and a closing latch guided in said guide opening and biased in a direction of said closing slide, said closing latch engages, when said flap is latched in place, in an open end of said closing slide guide, said closing slide drive unlatching said flap by moving said closing slide out of said latching opening by means of said latch element and simultaneously moving said closing latch out of said closing slide guide.

2. The flap configuration according to claim 1, wherein said flap is swivelable about a swivel axis of a glove compartment in a motor vehicle.

3. The flap configuration according to claim 1, wherein said closing slide drive has a wedge element movable orthogonally to a direction of displacement of said latch element.

4. The flap configuration according to claim 3, wherein said closing slide drive has an electrical actuator and a coupling member, said wedge element is connected via said coupling member to said electrical actuator.

5. The flap configuration according to claim 1, wherein said closing slide drive has an electrical stepping motor with a shaft, and an eccentric disposed on said shaft for displacing said latch element.

6. The flap configuration according to claim 1, wherein said closing slide and said closing latch each have a beveled closing edge, which, upon closure of said flap, bring about displacement of said closing slide and of said closing latch and introduction thereof into said latching opening or said closing slide guide respectively and reliably fix them in said latching opening or said closing slide guide respectively when said flap is closed.

7. The flap configuration according to claim 1, further comprising an actuating element for activating said closing slide drive and disposed so as to be ergonomically favorable for a driver of a motor vehicle.

8. A motor vehicle, comprising:

a flap configuration, including:

a flap for closing a receptacle;

a closing slide guide;

a closing slide drive;

a latch element;

a first receptacle wall having a latching opening formed therein;

a closing slide guided displaceably parallel to a flap plane in said closing slide guide, said closing slide can be inserted with one end into said latching opening in said receptacle wall and brought out of engagement with said latching opening by said closing slide drive against a spring force by way of said latch element being guided in said latching opening;

a second receptacle wall being opposite said first receptacle wall and having a guide opening formed therein positioned coaxially with said latching opening and coaxially with said closing slide guide; and a closing latch guided in said guide opening and biased in a direction of said closing slide, said closing latch engages, when said flap is latched in place, in an open end of said closing slide guide, said closing slide drive unlatching said flap by moving said closing slide out of said latching opening by means of said latch element and simultaneously moving said closing latch out of said closing slide guide.

* * * * *